US012696962B2

(12) United States Patent
Ozawa

(10) Patent No.: US 12,696,962 B2
(45) Date of Patent: Aug. 4, 2026

(54) SLIDER AND SLIDE FASTENER

(71) Applicant: YKK Corporation, Tokyo (JP)

(72) Inventor: Takanori Ozawa, Toyama-ken (JP)

(73) Assignee: YKK Corporation, Tokyo (JP)

( * ) Notice: Subject to any disclaimer, the term of this patent is extended or adjusted under 35 U.S.C. 154(b) by 176 days.

(21) Appl. No.: 18/849,971

(22) PCT Filed: Mar. 31, 2022

(86) PCT No.: PCT/JP2022/016704
§ 371 (c)(1),
(2) Date: Apr. 22, 2025

(87) PCT Pub. No.: WO2023/188333
PCT Pub. Date: Oct. 5, 2023

(65) Prior Publication Data
US 2025/0261727 A1 Aug. 21, 2025

(51) Int. Cl.
*A44B 19/00* (2006.01)
*A44B 19/26* (2006.01)
*A44B 19/30* (2006.01)

(52) U.S. Cl.
CPC ..... *A44B 19/262* (2013.01); *A44B 19/30* (2013.01)

(58) Field of Classification Search
CPC ..... A44B 19/30; A44B 19/262
See application file for complete search history.

(56) References Cited

U.S. PATENT DOCUMENTS 5,806,151 A * 9/1998 Uchiyama ..... A44B 19/303 24/418
9,003,614 B2 * 4/2015 Ozawa ..... A44B 19/26 24/429
9,254,020 B2 * 2/2016 Miyazaki ..... F16B 2/10
9,271,548 B2 * 3/2016 Keyaki ..... A44B 19/26
9,770,074 B2 * 9/2017 Lin ..... A44B 19/262
9,901,146 B2 * 2/2018 Tang ..... A44B 19/306
9,993,049 B2 * 6/2018 Miyazaki ..... A44B 19/262
10,064,456 B2 * 9/2018 Tang ..... B21D 53/52
10,098,421 B2 * 10/2018 Lin ..... A44B 19/306
(Continued)

FOREIGN PATENT DOCUMENTS

JP H10-042913 A 2/1998
JP 2004-344310 A 12/2004
(Continued)

OTHER PUBLICATIONS

International Preliminary Report on Patentability, PCT Patent Application No. PCT/JP2022/016704, Sep. 24, 2024, 7 pages.
(Continued)

*Primary Examiner* — Jason W San
(74) *Attorney, Agent, or Firm* — Kilpatrick Townsend & Stockton LLP

(57) ABSTRACT

A slider includes: a body; a pull tab; and a cover body. In a section orthogonal to a front-rear direction, at least a part of a gap between an abutting portion and a first abutted portion is smaller than a gap between a lower surface of an upper wall portion and a first facing wall upper surface portion, and at least a part of a gap between the abutting portion and a second abutted portion is smaller than a gap between the lower surface of the upper wall portion and a second facing wall upper surface portion.

7 Claims, 7 Drawing Sheets

(56) References Cited

U.S. PATENT DOCUMENTS

| | | | | |
|---|---|---|---|---|
| 10,405,616 | B2 * | 9/2019 | Lin | A44B 19/262 |
| 10,869,525 | B2 * | 12/2020 | Miyazaki | A44B 19/303 |
| 2004/0231115 | A1 * | 11/2004 | Keyaki | A44B 19/26 24/429 |
| 2013/0025092 | A1 * | 1/2013 | Ozawa | A44B 19/26 24/429 |
| 2013/0174387 | A1 * | 7/2013 | Hamada | A44B 19/303 24/418 |
| 2013/0185904 | A1 * | 7/2013 | Ozawa | A44B 19/306 24/418 |
| 2014/0033484 | A1 * | 2/2014 | Hamada | A44B 19/30 24/418 |
| 2014/0041163 | A1 * | 2/2014 | Hamada | A44B 19/30 24/418 |
| 2014/0331460 | A1 * | 11/2014 | Yamagishi | A44B 19/306 24/418 |
| 2020/0268114 | A1 | 8/2020 | Kojima et al. | |
| 2021/0137224 | A1 * | 5/2021 | Ozawa | A44B 19/30 |
| 2025/0261727 | A1 * | 8/2025 | Ozawa | A44B 19/262 |
| 2026/0096634 | A1 * | 4/2026 | Sugimoto | A44B 19/30 |

FOREIGN PATENT DOCUMENTS

| | | | | |
|---|---|---|---|---|
| JP | 4152254 | B2 | 7/2008 | |
| WO | WO-2011125152 | A1 * | 10/2011 | A44B 19/26 |
| WO | WO-2019092801 | A1 * | 5/2019 | A44B 19/26 |
| WO | WO-2023188333 | A1 * | 10/2023 | A44B 19/30 |
| WO | WO-2025169408 | A1 * | 8/2025 | A44B 19/26 |

OTHER PUBLICATIONS

International Search Report, PCT Patent Application No. PCT/JP2022/016704, Jun. 21, 2022, 5 pages.

Written Opinion, PCT Patent Application No. PCT/JP2022/016704, Jun. 21, 2022, 3 pages.

* cited by examiner

SLIDER AND SLIDE FASTENER

TECHNICAL FIELD

The present invention relates to a slider that opens and closes a pair of fastener stringers, and a slide fastener.

BACKGROUND ART

In the related art, a slide fastener is usually used at an opening and closing portion of clothes, bags, and the like. The slide fastener includes a pair of fastener stringers and a slider. The pair of fastener stringers are opened and closed by the slider. The slider basically includes a slider body including upper and lower blades whose front end portions are coupled at a prescribed interval by a guide column, and a pull tab that pulls the slider body (see Patent Literature 1).

CITATION LIST

Patent Literature

Patent Literature 1: JP4152254B

SUMMARY OF INVENTION

Technical Problem

In recent years, there has been a slider equipped with a cover body that holds a pull tab such that the pull tab is movable and pivotable with respect to an upper surface of a slider body. In many of such sliders, the pull tab is attached to the slider body by utilizing deformation when the cover body is pressed. Since the deformation of the cover body is utilized, the cover body is hard to be deformed when a thickness thereof increases, resulting in poor assemblability. When the cover body is made thin to improve the assemblability, the cover body may be excessively deformed and broken when applied with an impact.

The present invention is made in view of the above problems, and an object of the present invention is to provide a slider and a slide fastener that can improve impact resistance and assemblability of a cover body.

Solution to Problem

A slider according to the present invention includes: a body; a pull tab; and a cover-body, in which a side of the slider on which the pull tab is present is referred to as an upper side and an opposite side thereof is referred to as a lower side, when the slider is installed to a fastener chain, a direction in which the slider is slid to mesh left and right continuous element rows is referred to as a front side and a direction in which the slider is slid to separate the left and right continuous element rows is referred to as a rear side, and when the slider is viewed from the upper side, a left side in a front-rear direction is referred to as a left side and an opposite side thereof is referred to as a right side, the body includes an upper blade, a lower blade installed at a prescribed interval on the lower side of the upper blade, a guide column coupling the upper blade and the lower blade on the front side, and a first column portion protruding toward the upper side from a front portion of an upper surface of the upper blade, and a second column portion protruding toward the upper side from a rear portion of the upper surface of the upper blade, the first column portion includes a pair of first facing walls facing each other in a left-right direction, the second column portion includes a pair of second facing walls facing each other in the left-right direction, the pull tab includes a pivot installed between the first column portion and the second column portion, the cover body includes: an upper wall portion covering the first column portion, the second column portion, and the pivot; curved portions respectively curved and extending from the upper wall portion toward the front side and the lower side, and toward the rear side and the lower side; support portions extending from the respective curved portions toward the lower side and supported by the first column portion and the second column portion; and extending portions extending toward the lower side from the upper wall portion, the extending portions each include two abutting portions extending toward the lower side respectively from the front side and the rear side of the upper wall portion, the pair of the first facing walls each include a first abutted portion facing the abutting portion and a first facing wall upper surface portion facing a lower surface of the upper wall portion, the pair of second facing walls each include a second abutted portion facing the abutting portion and a second facing wall upper surface portion facing the lower surface of the upper wall portion, in a section orthogonal to the front-rear direction, at least a part of a gap between the abutting portion and the first abutted portion is smaller than a gap between the lower surface of the upper wall portion and the first facing wall upper surface portion, and at least a part of a gap between the abutting portion and the second abutted portion is smaller than a gap between the lower surface of the upper wall portion and the second facing wall upper surface portion.

Advantageous Effects of Invention

According to the slider and the slide fastener of the present invention, impact resistance and assemblability of a cover body can be improved.

DESCRIPTION OF EMBODIMENTS

Hereinafter, preferred embodiments of the present invention will be specifically described with reference to the drawings.

Figure 1:
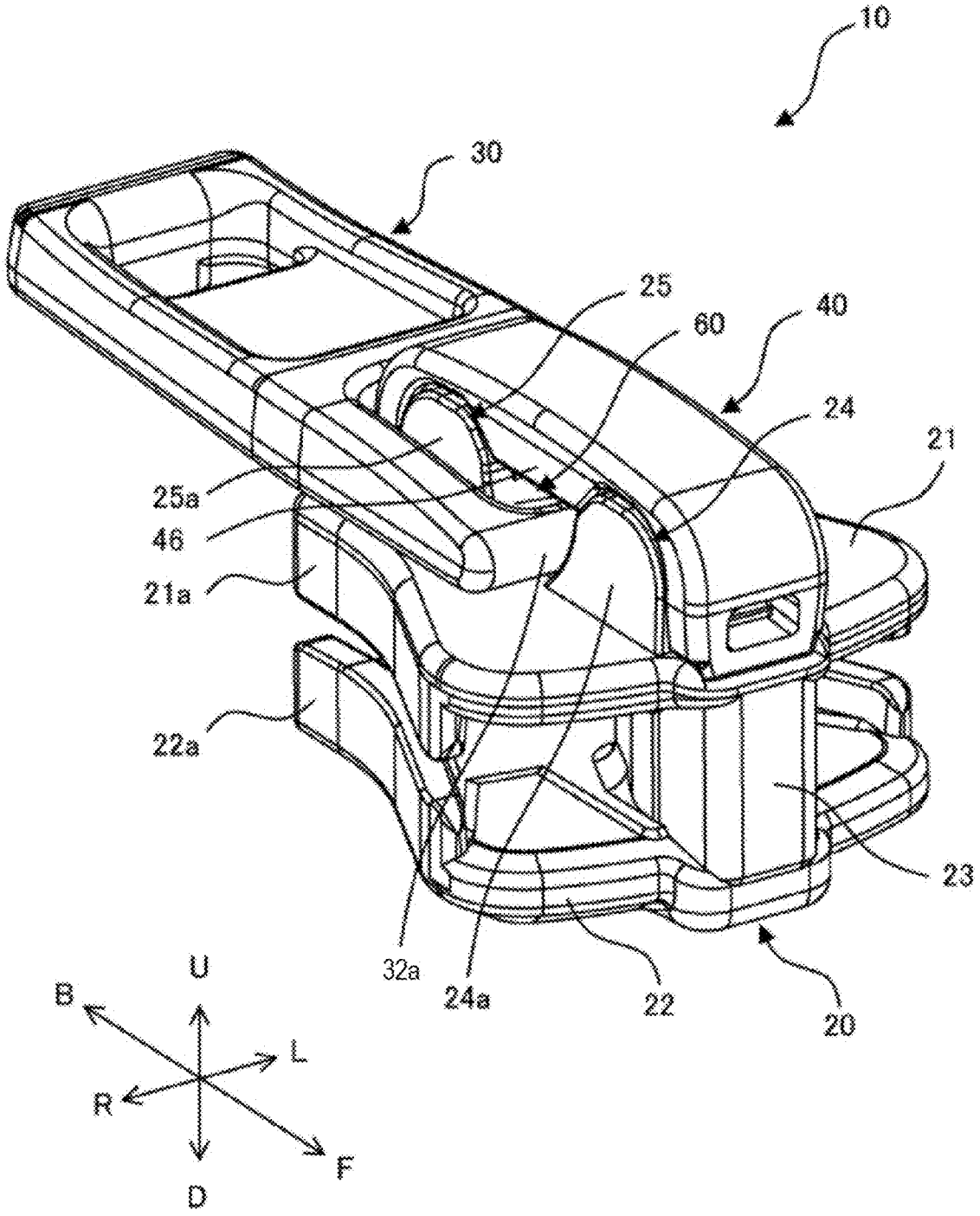
FIG. 1 shows a perspective view of a slider according to an embodiment.
Figure 2:
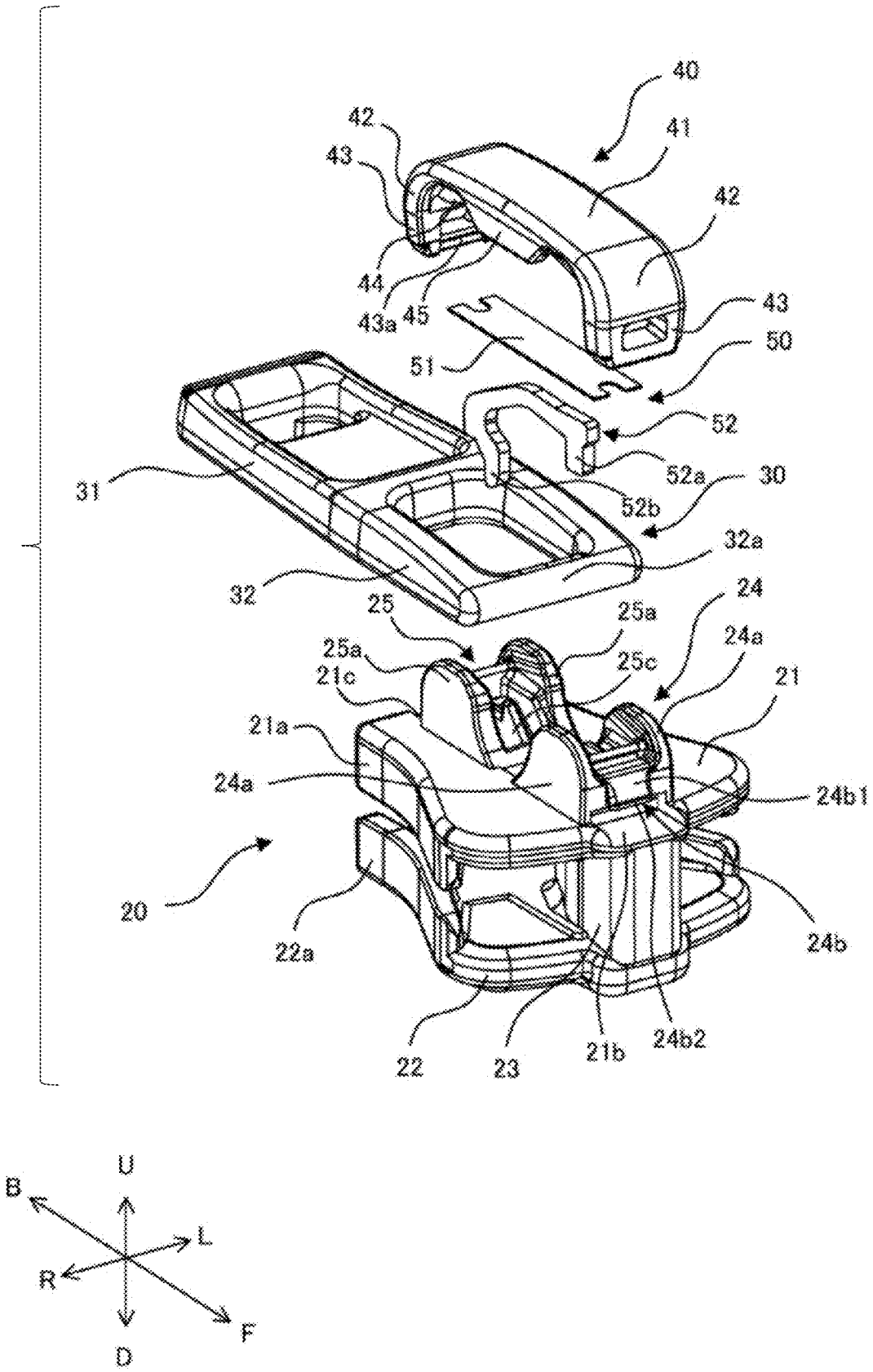
FIG. 2 shows a separated state of components constituting the slider of the present embodiment.
Figure 3:
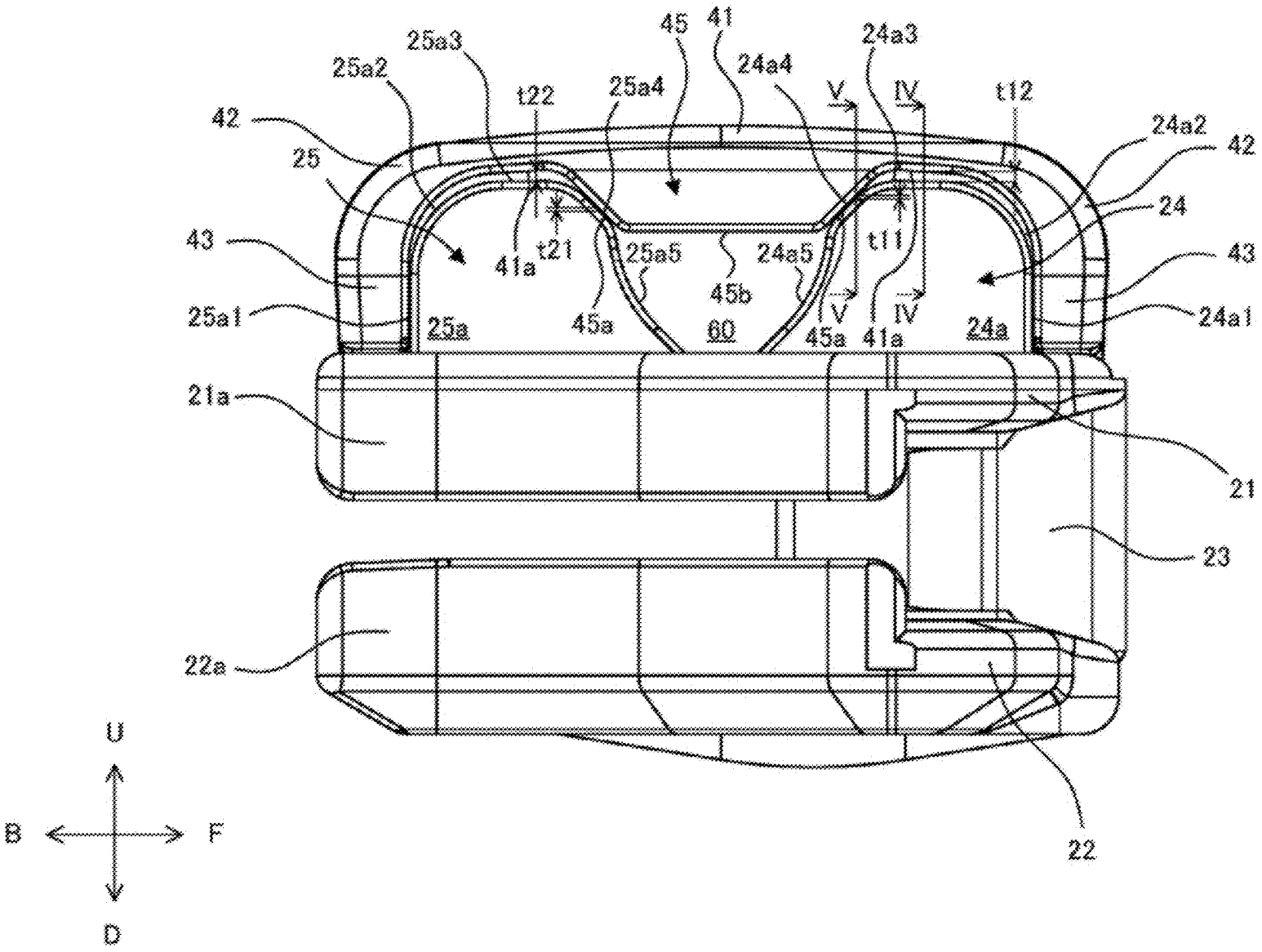
FIG. 3 shows a side view of the slider of the present embodiment.
Figure 4:
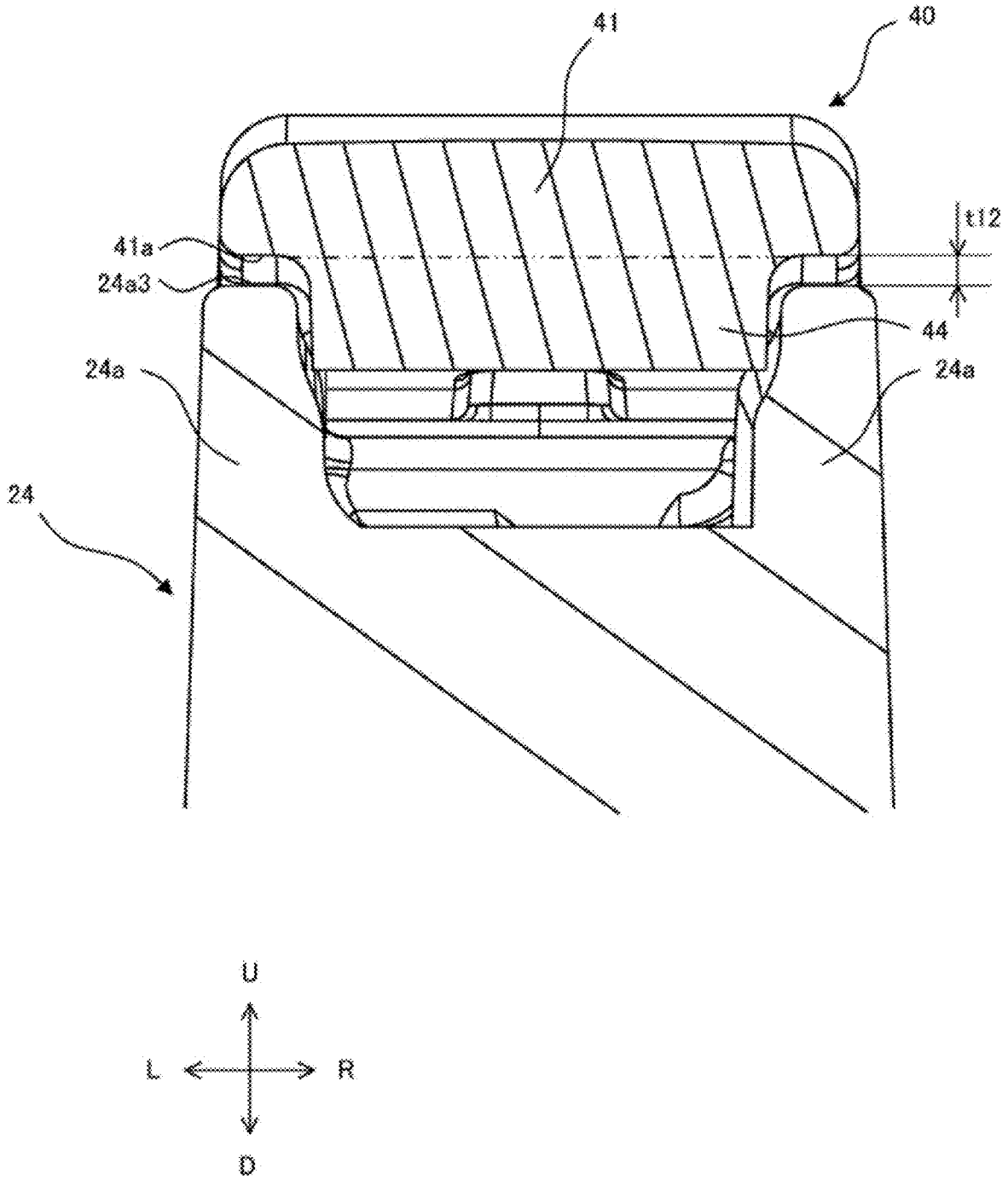
FIG. 4 shows an enlarged sectional view taken along a line IV-IV in FIG. 3.
Figure 5:
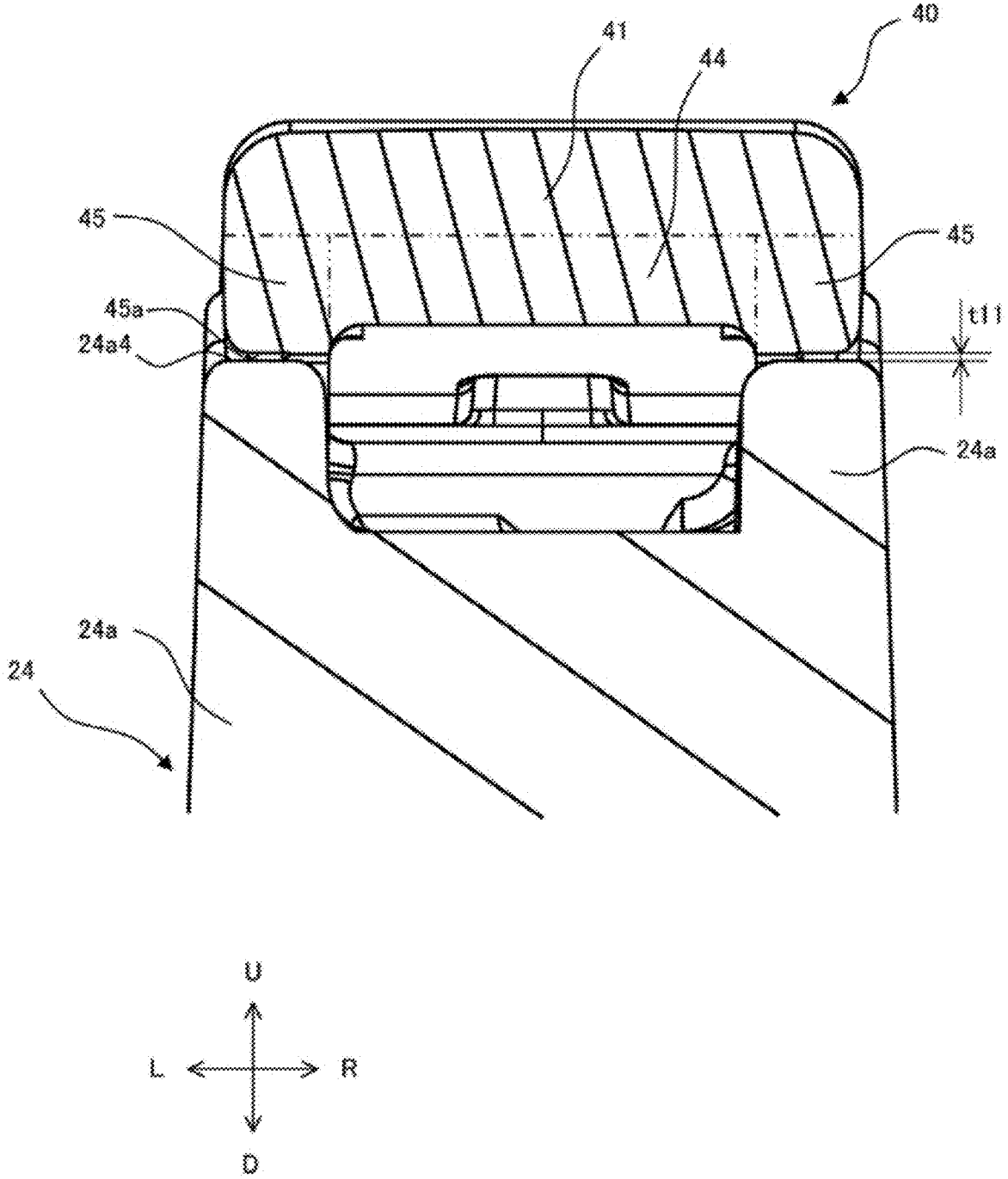
FIG. 5 shows an enlarged sectional view taken along a line V-V in FIG. 3.

FIG. 1 shows a perspective view of a slider according to an embodiment. FIG. 2 shows a separated state of components constituting the slider of the present embodiment. FIG. 3 shows a side view of the slider of the present embodiment. FIG. 4 shows an enlarged sectional view taken along a line IV-IV in FIG. 3. FIG. 5 shows an enlarged sectional view taken along a line V-V in FIG. 3.

Regarding directions in the following embodiments, a side of a slider 10 on which a pull tab 30 is present is referred to as an upper side U, and an opposite side thereof is referred to as a lower side D. Regarding other directions, a side on which a guide column 23 is present is referred to as a front side F, and an opposite side thereof is referred to as a rear side B. Regarding still other directions, when the slider 10 is viewed from the upper side U and the front side F is directed upward and the rear side B is directed downward, left is referred to as a left side L, and right is referred to as a right side R. The arrow U indicates the upper side, the arrow D indicates the lower side, the arrow F indicates the front side, the arrow B indicates the rear side, the arrow L indicates the left side, and the arrow R indicates the right side.

The slider 10 used in a slide fastener of the present embodiment includes four members, that is, a body 20, the pull tab 30, a cover body 40, and a lock body 50. The three members including the body 20, the pull tab 30, and the cover body 40 are each manufactured by injection molding using a thermoplastic resin such as polyamide, polypropylene, polyacetal, and poly butylene terephthalate, a thermoplastic resin material reinforced with a wear-resistant material, and the like. The three members including the body 20, the pull tab 30, and the cover body 40 can also be manufactured by die casting a metal material such as an aluminum alloy and a zinc alloy instead of a resin material.

The lock body 50 of the present embodiment is preferably made of a copper alloy, stainless steel, and the like. The lock body 50 may not be installed.

The body 20 includes an upper blade 21, a lower blade 22, and the guide column 23 coupling front portions of the upper and lower blades 21 and 22. The upper blade 21 includes, at each of left and right ends, a flange 21*a* extending toward the lower side D from a rear end to a substantially central position. The lower blade 22 includes, at each of left and right ends, a flange 22*a* extending toward the upper side U from a rear end to a substantially central position. The body 20 has a Y-shaped meshing element guide passage between the upper and lower blades 21 and 22.

On an upper surface of the upper blade 21 of the body 20, a first column portion 24 is erected on the front side F and a second column portion 25 is erected on the rear side B. The first column portion 24 and the second column portion 25 may be formed integrally with the upper blade 21. The first column portion 24 and the second column portion 25 define a space 60 for accommodating a pivot 31 of the pull tab therebetween. That is, the first column portion 24 and the second column portion 25 face each other before the pull tab 30 is placed on the upper surface of the upper blade 21. The upper surface of the upper blade 21 of the body 20 is provided with nothing between the first column portion 24 and the second column portion 25 that prevents the first column portion 24 and the second column portion 25 from facing each other.

The first column portion 24 includes a pair of first facing walls 24*a* that are arranged side by side and face each other in a left-right direction L-R. As shown in FIG. 3, when the first column portion 24 is viewed from a lateral side, each of the pair of first facing walls 24*a* includes, from the front side F toward the rear side B, a rising portion 24*a*1 extending perpendicularly to the upper blade 21, a convex curved portion 24*a*2 constituting a part of a curved shape convex toward the upper side U, a substantially horizontal first facing wall upper surface portion 24*a*3, a first abutted portion 24*a*4 inclined toward the lower side D, and a concave curved portion 24*a*5 constituting a part of a curved shape concave toward the upper side U. The rising portion 24*a*1 may also be inclined with respect to the upper blade 21 as long as engagement and disengagement of the cover body 40 to be described later is not hindered. A degree of curvature of the concave curved portion 24*a*5 is not limited and the concave curved portion 24*a*5 may be linear as long as the space 60 can be defined to an extent of not interfering with accommodation of the pivot 31 of the pull tab.

As shown in FIG. 2, a linear first lock portion 24*b*, which extends across facing surfaces of the pair of first facing walls 24*a*, is integrally formed on a front surface of the first column portion 24. The first lock portion 24*b* includes a first inclined portion 24*b*1, which protrudes forward of the rising portions 24*a*1 of the pair of first facing walls 24*a* and whose front surface is smoothly inclined downward, and a first engagement portion 24*b*2 that is engaged with and disengaged from the cover body 40 at a lower end of the first inclined portion 24*b*1.

The upper blade 21 is formed with a first concave groove 21*b* from a front end in a center of the upper surface in the left-right direction L-R to a front end of the first column portion 24. The first concave groove 21*b* enlarges a space on the lower side D of the first engagement portion 24*b*2 of the first column portion 24.

The second column portion 25 includes a pair of second facing walls 25*a* that are arranged side by side and face each other in the left-right direction L-R. As shown in FIG. 3, when the second column portion 25 is viewed from the lateral side, each of the pair of second facing walls 25*a* includes, from the rear side B toward the front side F, a rising portion 25*a*1 extending perpendicularly to the upper blade 21, a convex curved portion 25*a*2 constituting a part of a curved shape that is convex toward the upper side U, a substantially horizontal second facing wall upper surface portion 25*a*3, a second abutted portion 25*a*4 inclined toward the lower side D, and a concave curved portion 25*a*5 constituting a part of a curved shape that is concave toward the upper side U. The rising portion 25*a*1 may also be inclined with respect to the upper blade 21 as long as engagement and disengagement of the cover body 40 to be described later is not hindered. A degree of curvature of the concave curved portion 25*a*5 is not limited and the concave curved portion 25*a*5 may be linear as long as the space 60 can be defined to an extent of not interfering with accommodation of the pivot 31 of the pull tab.

A linear second lock portion 25*b* (not shown), which extends across facing surfaces of the pair of second facing walls 25*a*, is integrally formed on a rear surface of the second column portion 25. Although not shown, the second lock portion 25*b* includes a second inclined portion 25*b*1, which protrudes rearward of the rising portions 25*a*1 of the pair of second facing walls 25*a* and whose rear surface is smoothly inclined downward, and a second engagement portion 25*b*2 that is engaged with and disengaged from the cover body 40 at a lower end of the second inclined portion 25*b*1.

The upper blade 21 is formed with a second concave groove 21*c* (not shown) from a rear end in a center of the upper surface in the left-right direction L-R to a rear end of the second column portion 25. The second concave groove 21*c* enlarges a space on the lower side D of the second engagement portion 25*b*2 of the second column portion 25.

The cover body 40 includes an upper wall portion 41 constituting an upper surface, front and rear curved portions 42 curved toward the lower side D from the front side F and the rear side B of the upper wall portion 41, support portions 43 extending from the curved portions 42 toward the lower side D, a bulging portion 44 covering a center of a lower surface 41*a* of the upper wall portion 41 in the left-right direction L-R and extending toward the lower side D. and a pair of extending portions 45 extending toward the lower side D from left and right end portions covering a center of the upper wall portion 41 in a front-rear direction F-B.

An upper surface of the upper wall portion 41 of the present embodiment has a smooth curved surface that is convex toward the upper side U. With the smooth convex curved surface, an interval between the front and rear support portions 43 is easily increased when the cover body 40 is assembled to the first column portion 24 and the second column portion 25 and the upper surface is pressed. As a result, the cover body 40 can be quickly assembled to the first column portion 24 and the second column portion 25. The upper surface may also be a flat surface or a concave curved surface.

The curved portions 42 of the present embodiment are smoothly curved toward the lower side D from the front side F and the rear side B of the upper wall portion 41. The support portions 43 are formed on the lower side D of the curved portions 42 and are assembled to the first column portion 24 and the second column portion 25. The curved portions 42 and the support portions 43 on the front side F and the rear side B of the present embodiment have the same shape, and can be quickly assembled to the first column portion 24 and the second column portion 25 without distinction between front and rear. The curved portions 42 and the support portions 43 on the front side F and the rear side B may have different shapes.

At lower ends of the support portions 43, engagement pieces 43*a*, which are elastically engaged with and disengaged from the first engagement portion 24*b*2 of the first lock portion 24*b* and the second engagement portion 25*b*2 of the second lock portion 25*b*, protrude inward. Lower surfaces of top ends of the engagement pieces 43*a* are preferably inclined surfaces inclined upward toward inside of the cover body 40.

By making the lower surfaces of the top ends of the engagement pieces 43*a* inclined surfaces inclined upward, the engagement pieces 43*a* are smoothly and stably guided to the first inclined portion 24*b*1 formed in the first lock portion 24*b* of the first column portion 24 and the second inclined portion 25*b*1 formed in the second lock portion 25*b* of the second column portion 25, and can be easily and accurately engaged with the first engagement portion 24*b*2 and the second engagement portion 25*b*2.

As shown in FIG. 4, the bulging portion 44 of the present embodiment covers a center of a back surface of the upper wall portion 41 in the left-right direction L-R and is formed toward the lower side D. The bulging portion 44 has a length in the left-right direction L-R smaller than a length of the upper wall portion 41 in the left-right direction L-R, and has a width set to be smaller than a width of the upper wall portion 41 by wall thicknesses of the pair of first facing walls 24*a* and the pair of second facing walls 25*a*.

A part of the bulging portion 44 is fitted into a gap between the pair of first facing walls 24*a* of the first column portion 24 and a gap between the pair of second facing walls 25*a* of the second column portion 25. In a section of this part orthogonal to the front-rear direction F-B, the cover body 40 is formed in a substantially T shape, and the lower surface 41*a* of the upper wall portion 41 faces upper surfaces of the pair of first facing walls 24*a* of the first column portion 24 and upper surfaces of the pair of second facing walls 25*a* of the second column portion 25.

In this manner, since a part of the bulging portion 44 is fitted and inserted between the pair of first facing walls 24*a* of the first column portion 24 and between the pair of second facing walls 25*a* of the second column portion 25, the cover body 40 can be prevented from moving to right and left with respect to the first column portion 24 and the second column portion 25.

As shown in FIG. 3, each of the pair of extending portions 45 of the present embodiment includes abutting portions 45*a* extending obliquely toward the lower side D from front and rear of the upper wall portion 41, and a central portion 45*b* formed in a substantially horizontal shape at a central part in the front-rear direction F-B. Each of the pair of extending portions 45 protrudes toward the lower side D in a wall shape from a respective one of the left and right end portions. Since the abutting portions 45*a* are inclined, a length of the extending portion 45 in the front-rear direction decreases downward. The central portion 45*b* protrudes toward the space 60 defined between the first column portions 24 and the second column portions 25. A part of the abutting portion 45*a* on the front side F of the extending portion 45 faces a respective one of the first abutted portions 24*a*4 of the pair of first facing walls 24*a* of the first column portion 24, and a part of the abutting portion 45*a* on the rear side B of the extending portion 45 faces a respective one of upper surfaces of the second abutted portions 25*a*4 of the pair of second facing walls 25*a* of the second column portion 25.

The abutting portion 45*a* and the first abutted portion 24*a*4, and the abutting portion 45*a* and the second abutted portion 25*a*4 of the present embodiment are normally installed with a gap therebetween, and abut against each other when the upper wall portion 41 is pressed from, for example, above. The abutting portion 45*a* and the first abutted portion 24*a*4, and the abutting portion 45*a* and the second abutted portion 25*a*4 may also be normally abutted against each other.

The first abutted portion 24*a*4 and the second abutted portion 25*a*4 of the present embodiment are inclined at 45 degrees or less with respect to the upper blade 21. The abutting portions 45*a* face the first abutted portion 24*a*4 and the second abutted portion 25*a*4 in a state in which the cover body 40 is attached to the first column portion 24 and the second column portion 25.

Since the first abutted portion 24*a*4 and the second abutted portion 25*a*4 are inclined at 45 degrees or less with respect to the upper blade 21, an abutment angle with the abutting portions 45*a* is nearly horizontal, and the abutting portions 45*a* can be stably held. When the cover body 40 is attached to the body 20, an assembly worker can quickly and accurately insert the extending portion 45 between the first column portion 24 and the second column portion 25.

The slider 10 of the present embodiment includes the lock body 50. The lock body 50 includes a plate spring 51 made of an elastic plate material and a claw member 52 pressed by the plate spring 51. The plate spring 51 has two ends supported by the first column portion 24 and the second column portion 25. The claw member 52 is disposed on the lower side D of the plate spring 51.

The claw member 52 includes a hook portion 52*a* and a claw 52*b*. The hook portion 52*a* protrudes toward the lower side D from one end of the claw member 52. The hook portion 52*a* is hooked to a holding portion (not shown)

formed in the first column portion 24. The claw 52*b* protrudes toward the lower side D from another end of the claw member 52. The claw 52*b* penetrates the upper blade 21 from a hole 25*c* formed in the second column portion 25.

The pull tab 30 includes a gripping portion 31 on one end side and an annular holding portion 32 on another end side. The gripping portion 31 is formed of an elongated strip-shaped plate member having a thickness around a periphery. The annular holding portion 32 has a substantially elliptical hole elongated in a longitudinal direction into which the first column portion 24 or the second column portion 25 can be fitted. The annular holding portion 33 has a tip end portion formed in a bridge shape as the pivot 32*a* that is movably or pivotably in the space 60) defined between the first column portion 24 and the second column portion 25. The pivot 32*a* is set to have a width larger than a width dimension of the pair of first facing walls 24*a* and the pair of second facing walls 25*a* in the left-right direction L-R. The pull tab 30 is not limited to this structure, and may have another structure.

Thereafter, assembly of the slider 10 will be described. First, an assembly worker inserts the annular holding portion 32 of the pull tab 30 across the second column portion 25 of the body 20, and places the entire pull tab 30 in a substantially horizontal posture. Thereafter, the assembly worker installs the claw member 52 from the upper side U such that the claw member 52 straddles the pivot 32*a* of the pull tab 30. The hook portion 52*a* of the claw member 52 is hooked to the holding portion, and the claw 52*b* penetrates the hole 25*c* on the lower side D. Thereafter, the assembly worker places the plate spring 51 on the upper side U of the claw member 52. Two ends of the plate spring 51 may be meshed with the first column portion 24 and the second column portion 25. In this state, the claw member 52 is urged toward the lower side D by the plate spring 51.

Thereafter, the assembly worker fits the cover body 40 into the first column portion 24 and the second column portion 25 from the upper side U of the pull tab 30. When the upper wall portion 41 of the cover body 40 is pressed toward the lower side D, the engagement pieces 43*a* of the support portions 43 come into contact with the first inclined portion 24*b*1 and the second inclined portion 25*b*1. When the upper wall portion 41 is further pressed, the support portions 43 slide on the first inclined portion 24*b*1 and the second inclined portion 25*b*1, the upper wall portion 41 is elastically deformed, and the interval between the front and back support portions 43 is gradually enlarged. Thereafter, when the engagement pieces 43*a* pass through the first inclined portion 24*b*1 and the second inclined portion 25*b*1, the upper wall portion 41 elastically returns, and the engagement pieces 43*a* of the support portions 43 are engaged with the first engagement portion 24*b*2 of the first column portion 24 and the second engagement portion 25*b*2 of the second column portion 25. In this state, the assembly of the slider 10 is completed.

In a slider in the related art, when the upper wall portion 41 of the cover body 40 is pressed during assembly or use, small-thickness parts of the upper wall portion 41 come into contact with the pair of first facing walls 24*a* and the pair of second facing walls 25*a*. The small-thickness parts refers to end portions of the upper wall portion 41 in the left-right direction L-R in FIG. 4 that are located outward of the bulging portion 44 in the left-right direction. The small-thickness parts have a thickness in an upper-lower direction smaller than a thickness of the cover body 40 in the upper-lower direction in a position in which the bulging portion 44 is formed. When the small-thickness parts of the upper wall portion 41 are further pressed while being in contact with the pair of first facing walls 24*a* and the pair of second facing walls 25*a*, an excessive load is applied to the small-thickness parts of the upper wall portion 41 that has low strength, and the upper wall portion 41 may be broken.

To solve this problem, the slider 10 of the present embodiment is provided with the extending portions 45 on the cover body 40. In a section of the slider 10 of the present embodiment that is orthogonal to the front-rear direction F-B, at least a part of a gap t11 between the abutting portions 45*a* of the extending portions 45 and the first abutted portions 24*a*4 of the pair of first facing walls 24*a* shown in FIG. 5 is smaller than a gap t12 between the lower surface 41*a* of the upper wall portion 41 and the first facing wall upper surface portions 24*a*3 of the pair of first facing walls 24*a* shown in FIG. 4. At least a part of a gap t21 (not shown) between the abutting portions 45*a* of the extending portions 45 and the second abutted 20) portions 25*a*4 of the pair of second facing walls 25*a* is smaller than a gap t22 between the lower surface 41*a* of the upper wall portion 41 and the second facing wall upper surface portions 25*a*3 of the pair of second facing walls 25*a*.

Since the gaps t11 and t21 are smaller than the gaps t12 and t22, when the upper wall portion 41 is pressed, the abutting portions 45*a* and the first abutted portions 24*a*4 or the abutting portions 45*a* and the second abutted portions 25*a*4 abut against each other and receive a load before the lower surface 41*a* of the upper wall portion 41 and the first facing wall upper surface portions 24*a*3 or the lower surface 41*a* of the upper wall portion 41 and the second facing wall upper surface portions 25*a*3 do. Accordingly, large-thickness parts by the extending portions 44 receive a load before the small-thickness parts of the upper wall portion 41 do, and no excessive load is applied to the lower surface 41*a* of the small-thickness parts of the upper wall portion 41, and damage to the cover body 40 can be remarkably reduced.

The gap t11 between the abutting portions 45*a* and the first abutted portions 24*a*4 of the pair of first facing walls 24*a* may be the same as or different from the gap t21 between the abutting portions 45*a* and the second abutted portions 25*a*4 of the pair of second facing walls 25*a*. The gap t12 between the lower surface 41*a* of the upper wall portion 41 and the first facing wall upper surface portions 24*a*3 of the pair of first facing walls 24*a* may be the same as or different from the gap t22 between the lower surface 41*a* of the upper wall portion 41 and the second facing wall upper surface portions 25*a*3 of the pair of second facing walls 25*a*. Further, the abutting portions 45*a* and the first abutted portions 24*a*4 of the pair of first facing walls 24*a*, and the abutting portions 45*a* and the second abutted portions 25*a*4 of the pair of second facing walls 25*a* may be normally in contact with each other. In this case, the gap t11 between the abutting portions 45*a* and the first abutted portions 24*a*4 of the pair of first facing walls 24*a* and the gap t21 between the abutting portions 45*a* and the second abutted portions 25*a*4 of the pair of second facing walls 25*a* may be zero.

Figure 6:
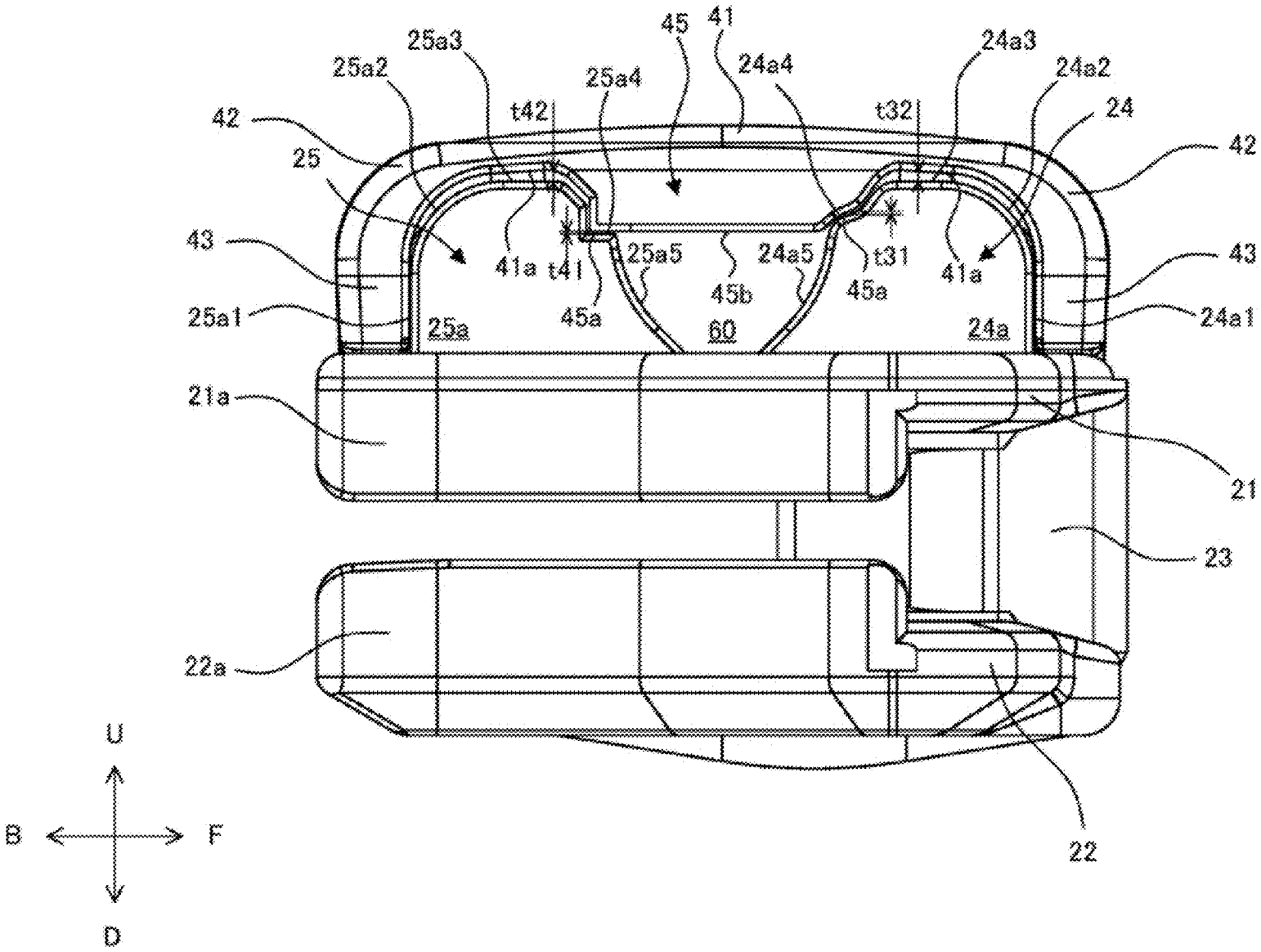
FIG. 6 shows a side view of a slider according to another embodiment.

FIG. 6 shows a side view of a slider according to another embodiment.

The abutting portions 45*a*, the first abutted portions 24*a*4, and the second abutted portions 25*a*4 are not limited to these shapes, and may be formed in a curved surface shape or a stepped shape as shown in FIG. 6. The shape of the first abutted portions 24*a*4 may be different from the shape of the second abutted portions 25*a*4. When the first abutted portions 24*a*4 and the second abutted portions 25*a*4 have different shapes, the abutting portions 45*a* may have shapes corresponding to the shapes of the first abutted portions

24*a*4 and the second abutted portions 25*a*4. The first abutted portions 24*a*4 may have different shapes within the pair of first facing walls 24*a*. In this case, the abutting portions 45*a* of each of the pair of extending portions 45 may have shapes corresponding to the shapes of the respective first abutted portions 24*a*4 of the pair of first facing walls 24*a* that face the abutting portions 45*a*. The same applies to the pair of second facing walls 25*a*.

Since the shapes of the abutting portions 45*a*, the first abutted portions 24*a*4, and the second abutted portions 25*a*4 can be variously changed, design of the cover body 40 can be diversified. For example, a load can be uniformly received by forming the abutting portions 45*a*, the first abutted portions 24*a*4, and the second abutted portions 25*a*4 in inclined shapes, and the load can be received in a state close to a horizontal plane by forming the abutting portions 45*a*, the first abutted portions 24*a*4, and the second abutted portions 25*a*4 at 45 degrees or less with respect to the upper blade 21. Further, a stronger load can be received in a horizontal plane by forming the abutting portions 45*a*, the first abutted portions 24*a*4, and the second abutted portions 25*a*4 in stepped shapes.

Also in a section of the slider 10 of the embodiment shown in FIG. 6 that is orthogonal to the front-rear direction F-B, at least a part of a gap t31 between the abutting portions 45*a* of the extending portions 45 and the first abutted portions 24*a*4 of the pair of first facing walls 24*a* is smaller than a gap t32 between the lower surface 41*a* of the upper wall portion 41 and the first facing wall upper surface portions 24*a*3 of the pair of first facing walls 24*a*. At least a part of a gap t41 between the abutting portions 45*a* of the extending portions 45 and the second abutted portions 25*a*4 of the pair of second facing walls 25*a* is smaller than a gap t42 between the lower surface 41*a* of the upper wall portion 41 and the second facing wall upper surface portions 25*a*3 of the pair of second facing walls 25*a*.

Since the gaps t31 and t41 are smaller than the gaps t32 and t42, when the upper wall portion 41 is pressed, the abutting portions 45*a* and the first abutted portions 24*a*4 or the abutting portions 45*a* and the second abutted portions 25*a*4 abut against each other and receive a load before the lower surface 41*a* of the upper wall portion 41 and the first facing wall upper surface portions 24*a*3 or the lower surface 41*a* of the upper wall portion 41 and the second facing wall upper surface portions 25*a*3 do. Accordingly, no excessive load is applied to the lower surface 41*a* of the small-thickness parts of the upper wall portion 41, and damage to the cover body 40 is remarkably reduced. In this manner, any shape may be adopted as long as the large-thickness parts by the extending portions 45 abut against the column portions before the small-thickness parts do.

Figure 7:
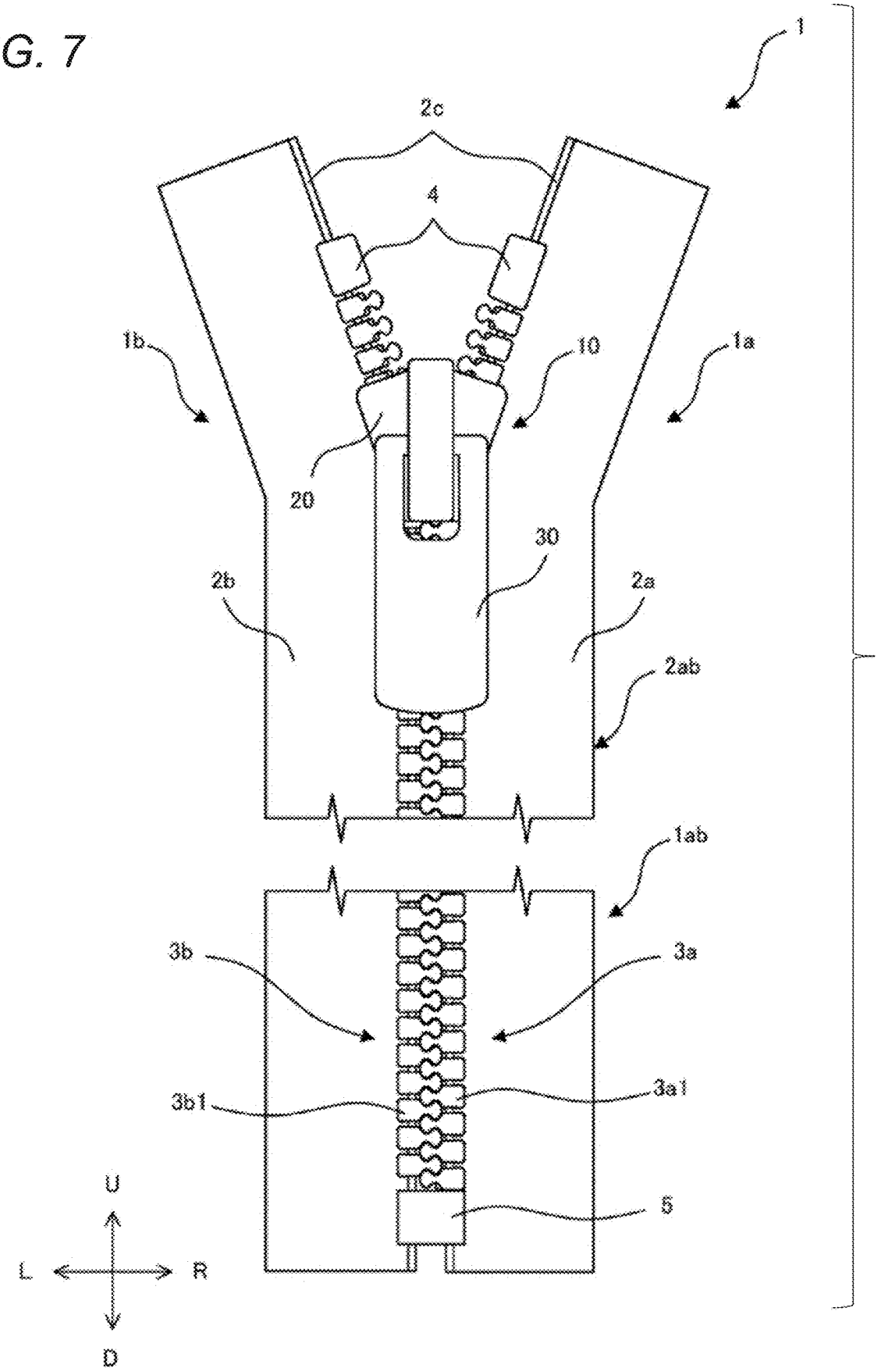
FIG. 7 shows a slide fastener using the slider of the present embodiment.

FIG. 7 shows a slide fastener using the slider of the present embodiment.

A slide fastener 1 of the present embodiment includes a pair of right and left fastener chain 1*ab* that includes a first fastener stringer 1*a*, in which a first element row 3*a* including a plurality of first elements 3*a*1 is fixed to a first fastener tape 2*a*, and a second fastener stringer 1*b*, in which a second element row 3*b* including a plurality of second elements 3*b*1 is fixed to a second fastener tape 2*b*, and the slider 10 that slides along the left and right continuous element rows 3*a* and 3*b* to mesh and separate the elements 3*a*1 and 3*b*1 of the continuous element rows 3*a* and 3*b*.

In the following description, a direction in which the continuous element rows are provided in a longitudinal direction of the fastener chain 1*ab* is referred to as the front-rear direction F-B, a direction in which the slider 10 is slid to mesh the left and right continuous element rows 3*a* and 3*b* is referred to as the front side F. and a direction in which the slider 10 is slid to separate the left and right continuous element rows 3*a* and 3*b* is referred to as the rear side B. The left-right direction L-R is a direction horizontal to a surface of the fastener chain 1*ab* and perpendicular to the front-rear direction. A direction perpendicular to a plane defined by the front-rear direction F-B and the left-right direction L-R is referred to as the upper-lower direction U-D, a side of the fastener chain 1*ab* on which the pull tab 30 of the slider 10 is present is referred to as the upper side U. and an opposite side thereof is referred to as the lower side D. The upper-lower direction U-D may be referred to as a surface-back direction, the upper side U may be referred to as a surface side, and the lower side D may be referred to as a back side.

The fastener chain 1*ab* includes the pair of fastener stringers 1*a* and 1*b*. The fastener stringers 1*a* and 1*b* include a pair of fastener tape 2*ab* having an upper surface and a lower surface, and the element rows 3*a* and 3*b* including the plurality of elements 3*a*1 and 3*b*1 fixed to respective edge portions 2*c* of the pair of fastener tapes 2*ab* at a prescribed pitch. The elements row 3*a* and 3*b* face each other.

Upper stoppers 4 are fixed to respective upper ends of the continuous element rows 3*a* and 3*b*, and a lower stopper 5 is fixed to lower ends of the continuous element rows 3*a* and 3*b*. This prevents the slider 10 from coming off from the upper and lower ends of the continuous element rows 3*a* and 3*b*. In the present embodiment, it is also possible to fix an opener having a separable pin and a retainer pin instead of the lower stopper 5.

As described above, a slider 10 of the present embodiment includes: a body 20; a pull tab 30; and a cover body 40. A side of the slider 10 on which the pull tab 30 is present is referred to as an upper side U and an opposite side thereof is referred to as a lower side D, when the slider 10 is installed to a fastener chain 1*ab*, a direction in which the slider 10 is slid to mesh left and right continuous element rows 3*a*, 3*b* is referred to as a front side F and a direction in which the slider 10 is slid to separate the left and right continuous element rows 3*a*, 3*b* is referred to as a rear side B. and when the slider 10 is viewed from the upper side U, a left side in a front-rear direction F-B is referred to as a left side L and an opposite side thereof is referred to as a right side R. The body 20 includes an upper blade 21, a lower blade 22 installed at a prescribed interval on the lower side D of the upper blade 21, a guide column 23 coupling the upper blade 21 and the lower blade 22 on the front side F. and a first column portion 24 protruding toward the upper side U from a front portion of an upper surface of the upper blade 21, and a second column portion 25 protruding toward the upper side U from a rear portion of the upper surface of the upper blade 21. The first column portion 24 includes a pair of first facing walls 24*a* arranged side by side in a left-right direction L-R. The second column portion 25 includes a pair of second facing walls 25*a* arranged side by side in the left-right direction L-R. The pull tab 30 includes a pivot 32*a* installed between the first column portion 24 and the second column portion 25. The cover body 40 includes: an upper wall portion 41 covering the first column portion 24, the second column portion 25, and the pivot 32*a*; curved portions 42 respectively curved and extending from the upper wall portion 41 toward the front side F and the lower side D, and toward the rear side B and the lower side D; support portions 43 extending from the respective curved portions 42 toward the lower side D and supported by the first column portion 24 and the second column portion 25; and extending portions 45 extending toward the lower side D from the upper wall portion 41. The extending portions 45 each include two abutting portions 45*a* extending toward the lower side D respectively from the front side F and the rear side B of the upper wall portion 41. The pair of the first facing walls 24*a* each include a first abutted portion 24*a*4 facing the abutting portion 45*a* and a first facing wall upper surface portion 24*a*3 facing a lower surface 41*a* of the upper wall portion 41. The pair of second facing walls 25*a* each include a second abutted portion 25*a*4 facing the abutting portion 45*a* and a second facing wall upper surface portion 25*a*3 facing the lower surface 41*a* of the upper wall portion 41. In a section orthogonal to the front-rear direction F-B, at least a part of a gap t11 between the abutting portion 45*a* and the first abutted portion 24*a*4 is smaller than a gap t12 between the lower surface 41*a* of the upper wall portion 41 and the first facing wall upper surface portion 24*a*3, and at least a part of a gap t21 between the abutting portion 45*a* and the second abutted portion 25*a*4 is smaller than a gap t22 between the lower surface 41*a* of the upper wall portion 41 and the second facing wall upper surface portion 25*a*3.

Accordingly, when the upper wall portion 41 is pressed, the abutting portions 45*a* and the first abutted portions 24*a*4 or the abutting portions 45*a* and the second abutted portions 25*a*4, which have a smaller gap than a gap between the lower surface 41*a* of the upper wall portion 41 and the first facing wall upper surface portions 24*a*3 or between the lower surface 41*a* of the upper wall portion 41 and the second facing wall upper surface portions 25*a*3, abut against each other and receive a load first. Accordingly, no excessive load is applied to the lower surface 41*a* of the small-thickness parts of the upper wall portion 41, damage to the cover body 40 can be remarkably reduced, impact resistance of the cover body 40 can be improved, and excellent assemblability can be achieved.

In the slider 10 of the present embodiment, when the abutting portion 45*a* and the first abutted portion 24*a*4 abut against each other, the lower surface 41*a* of the upper wall portion 41 and the first facing wall upper surface portion 24*a*3 have a gap therebetween, and when the abutting portion 45*a* and the second abutted portion 25*a*4 abut against each other, the 30) lower surface 41*a* of the upper wall portion 41 and the second facing wall upper surface portion 25*a*3 have a gap therebetween.

Since the abutting portions 45*a* and the first abutted portions 24*a*4 or the abutting portions 45*a* and the second abutted portions 25*a*4 abut against each other and receive the load, no excessive load is applied to the lower surface 41*a* of small-thickness parts of the upper wall portion 41, damage of the cover body 40 can be further remarkably reduced, and the impact resistance of the cover body 40 can be further improved.

In the slider 10 of the present embodiment, the cover body 40 includes a bulging portion 44 that covers a center of the lower surface 41*a* of the upper wall portion 41 in the left-right direction L-R and that extends toward the lower side D, a part of the bulging portion 44 is disposed between the pair of first facing walls 24*a* and between the pair of second facing walls 25*a*, and the extending portions 45 extend toward the lower side D from left and right end portions of the lower surface 41*a* of the upper wall portion 41.

Accordingly, since a part of the bulging portion 44 is fitted and inserted between the pair of first facing walls 24*a* of the first column portion 24 and between the pair of second facing walls 25*a* of the second column portion 25, the cover body 40 can be prevented from moving to right and left with respect to the first column portion 24 and the second column portion 25.

In the slider 10 of the present embodiment, at least one of the abutting portion 45*a*, the first abutted portion 24*a*4, and the second abutted portion 25*a*4 has an inclined shape inclined with respect to the upper blade 21. Accordingly, the load can be uniformly received by forming the abutting portions 45*a*, the first abutted portions 24*a*4, and the second abutted portions 25*a*4 in inclined shapes.

In the slider 10 of the present embodiment, an inclination angle of the inclined shape with respect to the upper blade 21 is 45 degrees or less. Accordingly, by making the inclination angle 45 degrees or less with respect to the upper blade 21, the load can be received in a state close to a horizontal plane.

In the slider 10 of the present embodiment, at least one of the abutting portion 45*a*, the first abutted portion 24*a*4, and the second abutted portion 25*a*4 is formed in a stepped shape. Accordingly, a stronger load can be received in a horizontal plane by forming the abutting portions 45*a*, the first abutted portions 24*a*4, and the second abutted portions 25*a*4 in stepped shapes.

A slide fastener 1 of the present embodiment includes: a pair of right and left fastener chain 1*ab* that includes a first fastener stringer 1*a* in which a first element row 3*a* including a plurality of first elements 3*a*1 is fixed to a first fastener tape 2*a*, and a second fastener stringer 1*b* in which a second element row 3*b* including a plurality of second elements 3*b*1 is fixed to a second fastener tape 2*b*; and the slider 10 configured to slide along the left and right continuous element rows 3*a* and 3*b* to mesh and separate the elements 3*a*1 and 3*b*1 of the continuous element rows 3*a* and 3*b*.

Accordingly, when the upper wall portion 41 is pressed, the abutting portions 45*a* and the first abutted portions 24*a*4 or the abutting portions 45*a* and the second abutted portions 25*a*4, which have a smaller gap than a gap between the lower surface 41*a* of the upper wall portion 41 and the first facing wall upper surface portions 24*a*3 or between the lower surface 41*a* of the upper wall portion 41 and the second facing wall upper surface portions 25*a*3, abut against each other and receive a load first. Accordingly, no excessive load is applied to the lower surface 41*a* of the small-thickness parts of the upper wall portion 41, damage to the cover body 40 can be remarkably reduced, impact resistance of the slide fastener 1 can be improved, and excellent assemblability can be achieved.

REFERENCE SIGNS LIST

1: slide fastener
1*ab*: fastener chain
1*a*, 1*b*: fastener stringer
2*ab*: fastener tape
3*a*1, 3*b*1: element
3*a*, 3*b*: element row
10: slider
20: body
21: upper blade
21*a*, 22*a*: flange
22: lower blade
23: guide column
24: first column portion
24*a*: first facing wall
24*a*3: first facing wall upper surface portion
24*a*4: first abutted portion
24*b*: first lock portion

25: second column portion
25*a*: second facing wall
25*a*3: second facing wall upper surface portion
25*a*4: second abutted portion
25*b*: second lock portion
30: pull tab
31: gripping portion
32: annular holding portion
33: pivot
40: cover body
41: upper wall portion
41*a*: lower surface
42: curved portion
43: support portion
44: bulging portion
45: extending portion
45*a*: abutting portion
50: lock body
51: plate spring
52: claw member

The invention claimed is:

1. A slider comprising: a body; a pull tab; and a cover body, wherein a side of the slider on which the pull tab is present is referred to as an upper side and an opposite side thereof is referred to as a lower side, when the slider is installed to a fastener chain, a direction in which the slider is slid to mesh left and right continuous element rows is referred to as a front side and a direction in which the slider is slid to separate the left and right continuous element rows is referred to as a rear side, and when the slider is viewed from the upper side, a left side in a front-rear direction is referred to as a left side and an opposite side thereof is referred to as a right side, the body includes an upper blade, a lower blade installed at a prescribed interval on the lower side of the upper blade, a guide column coupling the upper blade and the lower blade on the front side, and a first column portion protruding toward the upper side from a front portion of an upper surface of the upper blade, and a second column portion protruding toward the upper side from a rear portion of the upper surface of the upper blade, the first column portion includes a pair of first facing walls arranged side by side in a left-right direction, the second column portion includes a pair of second facing walls arranged side by side in the left-right direction, the pull tab includes a pivot installed between the first column portion and the second column portion, the cover body includes: an upper wall portion covering the first column portion, the second column portion, and the pivot; curved portions respectively curved and extending from the upper wall portion toward the front side and the lower side, and toward the rear side and the lower side; support portions extending from the respective curved portions toward the lower side and supported by the first column portion and the second column portion; and extending portions extending toward the lower side from the upper wall portion, the extending portions each include two abutting portions extending toward the lower side respectively from the front side and the rear side of the upper wall portion, the pair of the first facing walls each include a first abutted portion facing the abutting portion and a first facing wall upper surface portion facing a lower surface of the upper wall portion, the pair of second facing walls each include a second abutted portion facing the abutting portion and a second facing wall upper surface portion facing the lower surface of the upper wall portion, in a section orthogonal to the front-rear direction, at least a part of a gap between the abutting portion and the first abutted portion is smaller than a gap between the lower surface of the upper wall portion and the first facing wall upper surface portion, and at least a part of a gap between the abutting portion and the second abutted portion is smaller than a gap between the lower surface of the upper wall portion and the second facing wall upper surface portion.

2. The slider according to claim 1, wherein when the abutting portion and the first abutted portion abut against each other, the lower surface of the upper wall portion and the first facing wall upper surface portion have a gap therebetween, and when the abutting portion and the second abutted portion-abut against each other, the lower surface of the upper wall portion and the second facing wall upper surface portion have a gap therebetween.

3. The slider according to claim 1, wherein the cover body includes a bulging portion that covers a center of the lower surface of the upper wall portion in the left-right direction and that extends toward the lower side, a part of the bulging portion is disposed between the pair of first facing walls and between the pair of second facing walls, and the extending portions extend toward the lower side from left and right end portions of the lower surface of the upper wall portion.

4. The slider-according to claim 1, wherein at least one of the abutting portion, the first abutted portion, and the second abutted portion has an inclined shape inclined with respect to the upper blade.

5. The slider according to claim 4, wherein an inclination angle of the inclined shape with respect to the upper blade is 45 degrees or less.

6. The slider according to claim 1, wherein at least one of the abutting portion, the first abutted portion, and the second abutted portion is formed in a stepped shape.

7. A slide fastener comprising:

a pair of left and right fastener chain that includes a first fastener stringer in which a first element row-including a plurality of first elements is fixed to a first fastener tape, and a second fastener stringer in which a second element row including a plurality of second elements is fixed to a second fastener tape; and the slider according to claim 1 configured to slide along the left and right continuous element rows to mesh and separate the elements of the continuous element rows.

* * * * *